US005868509A

United States Patent [19]

Crutcher

[11] Patent Number: 5,868,509

[45] Date of Patent: Feb. 9, 1999

[54] HOLDER FOR A WRITING INSTRUMENT

[76] Inventor: William C. Crutcher, P.O. Box 276, Middlebury, Conn. 06762

[21] Appl. No.: 802,779

[22] Filed: Feb. 16, 1997

[51] Int. Cl.[6] ..... B43K 23/012

[52] U.S. Cl. ..... 401/8; 401/7

[58] Field of Search ..... 401/7, 8; 15/437, 15/443

[56] References Cited

U.S. PATENT DOCUMENTS

| | | | |
|---|---|---|---|
| 36,652 | 10/1862 | Jacobs | 401/8 |
| D. 328,920 | 8/1992 | Kimball | 401/8 X |
| 343,391 | 6/1886 | Peiter | 401/8 |
| 967,410 | 8/1910 | Montgomery | 401/8 |
| 1,681,842 | 8/1928 | Collen | 401/8 |
| 1,906,267 | 5/1933 | Hogg | 401/8 |
| 2,273,044 | 2/1942 | Johnson | 401/8 |
| 3,075,498 | 1/1963 | Udkoff . | |
| 3,402,984 | 9/1968 | Zazzara | 401/8 |
| 4,738,556 | 4/1988 | Brown | 401/7 |
| 5,310,345 | 5/1994 | Gershon | 434/166 |
| 5,314,260 | 5/1994 | Andersson | 401/7 |

FOREIGN PATENT DOCUMENTS

| | | | |
|---|---|---|---|
| 158264 | 8/1954 | Australia | 401/8 |
| 813926 | 6/1937 | France | 401/8 |
| 2461387 | 7/1976 | Germany | 401/7 |
| 7756 | 4/1892 | United Kingdom | 15/443 |
| 24234 | 11/1905 | United Kingdom | 15/443 |

*Primary Examiner*—Steven A. Bratlie

[57] ABSTRACT

A holder for a short pen or pencil to be worn on the upper (dorsal)side of the index finger while doing other work, and permitting writing without hunting for a writing instrument. Variations of flexible plastic and/or elastomeric one piece holders from extrusions or injection molded parts are disclosed as well as holders with Velcro straps. The sleeve holding the writing instrument may be parallel to the middle joint of the index finger or inclined to it, and may be adjusted with a thumb piece on the holder.

6 Claims, 3 Drawing Sheets

HOLDER FOR A WRITING INSTRUMENT

BACKGROUND OF THE INVENTION

This invention relates to holders for writing instruments, such as a pen or pencil, and more particularly to such a holder adapted to be continuously worn on the finger of an operator.

One of the most common problems facing everyone is that of the missing pen or pencil when working at a task that requires occasional, rather than continuous, use of the writing instrument. While one solution is to put the pen or pencil in a container or a pocket, it takes time to fish it out and prepare it for use.

It would be very desirable and useful to have a holder for the writing instrument immediately available for use. However, the holder must not impede the work which is going on or hamper the hand action of the operator who requires occasional use of the pen or pencil.

The prior art has suggested writing instrument holders to be carried on one or more fingers of the hand. Some of these devices are for the purpose of holding a writing instrument or other tool in a more secure manner in the normal writing position adjacent or beneath the tip or distal phalanx of the index finger. U.S. Pat. No. 3,075,498 issued Jan. 28, 1963 to S. Udcoff employs a split finger ring carried on the proximal phalanx, supporting a tubular pencil carrying member pivoted on the end thereof, with coil springs to return it from an operative position aside the index finger to a retracted position. U.S. Pat. No. 5,310,345 issued May 10, 1994 to J. Gershon discloses a writing aid having two pocket shaped sleeves, one for the tip of the index finger and one for the tip of the thumb, and a central section adapted to frictionally hold a writing instrument in a conventional writing position. U.S. Pat. No. 3,402,984, issued Sep. 24, 1968 to J. Zazzara discloses a tubular tapered sleeve adapted to be slid over the distal and middle phalanges, including the joint therebetween. The sleeve carries a swivel clamp for receiving a pen or pencil, which may be pivoted on the side of the sleeve. A pen holder advertised in a contemporary catalog as Griffi comprises a longitudinally slidable sleeve for holding a conventional ball point pen by means of a ring attached to the sleeve by a swivel joint and intended to be worn on the proximal phalanx or upper joint of the index finger.

The prior art also discloses finger holders for writing instruments of a less conventional nature. U.S. Pat. No. 4,738,556 issued Apr. 19, 1988 to J. Brown discloses a finger mounted ball point pen with a padded tray passing along the ventral side of the distal phalanx and secured to the finger tip with a Velcro strip passing around the dorsal side of the distal phalanx. The pen projects beyond the tip of the finger to form an extension of the index finger. U.S. Pat. No. 5,314,260 issued May 24, 1994 to J. Andersson discloses a finger pen with a writing tip projecting from a contoured ventral pad with an integral ring adapted to fit over the distal phalanx and write with the palm in a prone position.

The foregoing prior art devices suffer from mechanical complexity or impede the free action of the fingers to do other tasks. It would be desirable to have a holder for a writing instrument which always deploys the writing instrument in a writing position without impeding action of the fingers or substantially interfering with other tasks.

SUMMARY OF THE INVENTION

Accordingly one object of the present invention is to provide an improved finger holder for a writing instrument which is always available without interfering with use of the fingers.

Another object of the invention is to provide an improved finger holder for a writing instrument which is simpler than prior art devices and easy to manufacture.

Briefly stated, the invention comprises a holder for a writing instrument such as a pen or pencil having a scribing point on one end to be held on the dorsal side of the middle phalanx of the index finger. The improved holder comprises a finger engaging member adapted to fit on the middle phalanx without substantially impeding articulation of the adjoining phalanges, said finger engaging member having a dorsal facing arcuate saddle portion and a ventral facing holding portion cooperating with the saddle portion to grip the middle phalanx, an instrument sleeve defining a substantially cylindrical passage adapted to receive the writing instrument, the instrument sleeve having means for preventing longitudinal movement in the cylindrical passage, and connecting means rigidly supporting the instrument sleeve from the saddle member above the dorsal side of the middle phalanx and directing the cylindrical passage so that when the writing instrument is placed in the cylindrical passage the scribing point may terminate at the tip of the index finger on the upper or dorsal side thereof.

In a preferred form, the holder may be constructed of an integral plastic member to provide the finger engaging member, the instrument sleeve, and the connecting means and having flexible sections to provide the respective finger gripping means and the longitudinal movement preventing means.

Modified forms of the invention provide for the connecting means to direct the axis of the cylindrical passage at a slight angle to the axis of the finger engaging member so that the scribing point of the writing instrument terminates in closer proximity to the finger tip for improved writing control. Other types of finger gripping means and longitudinal movement preventing means are disclosed as modified forms of the invention.

DRAWINGS

Other objects and advantages of the invention will be more clearly understood by reference to the following description, taken in connection with the accompanying drawings in which:

FIG. 1 is a side elevational drawing of the improved holder in use together with a writing instrument and portions of an operator's hand in simplified form, FIG. 2 is the same side elevational view of the holder without writing instrument or hand portions, FIG. 3 is an end elevational view of the holder of FIG. 2, FIG. 4 is an elevational view in cross section, taken along lines IV—IV of FIG. 3, FIG. 5 is the same elevational view of the holder of FIG. 4 in cross section, together with writing instrument and the index finger of the operator, FIG. 6 is a side elevational view of a modified form of the invention in use together with a writing instrument and portions of an operator's hand in simplified form, FIG. 7 is the same side elevational view of the holder of FIG. 6 without writing instrument or hand portions, FIG. 8 is a front end elevational view of the holder of FIG. 7, FIG. 9 is a rear end elevational view of the holder of FIG. 7, FIG. 10 is an elevational view in cross section, taken along lines X—X of FIG. 9, FIG. 11 is the same elevational view of the holder of FIG. 10 in cross section, together with writing instrument and the index finger of the operator, FIG. 12 is a side elevational view of still another modified form of the invention, FIG. 13 is a front end elevational view of the holder of FIG. 12, FIG. 14 is a rear end elevational view of the holder of FIG. 12, FIG. 15 is an elevational view in cross section, taken along lines XV—XV of FIG. 13.

FIG. 16 is an elevational end view of another modification of the invention, and FIG. 17 is a side elevational view of the modified holder of FIG. 16 being used with a writing instrument on the index finger of an operator.

DESCRIPTION OF THE PREFERRED EMBODIMENT

Figure 1:
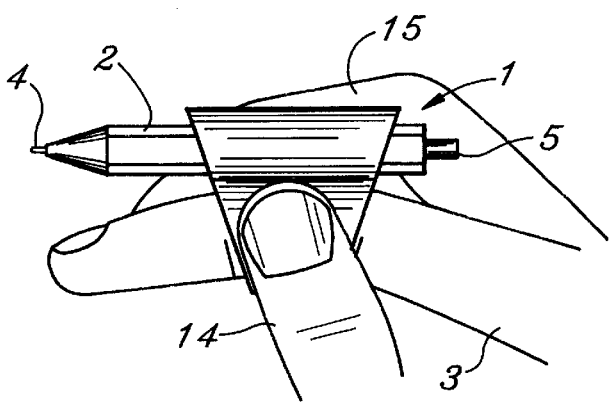

Referring now to FIGS. 1–5, the invention is shown in simplest form. In FIG. 1, the improved holder, shown generally at 1, is adapted to carry a writing instrument 2 on the index finger 3 of an operator. The writing instrument may either be a pen or a pencil, which is of conventional construction except that it is much shorter than a normal pen or pencil, preferably about 2 to 2½ inches long. The instrument 2 has a scribing point 4, and is held against longitudinal movement in the holder by means to be described. If the writing instrument is a ball point pen, it preferably has a plunger 5 adapted to retract or to advance the scribing point 4 in a conventional manner. In contrast to prior art finger holders, it is important to note that the writing instrument 2 is held on the dorsal, or back side of the index finger 3 and is carried entirely on the middle phalanx or middle joint of the index finger.

Figure 4:
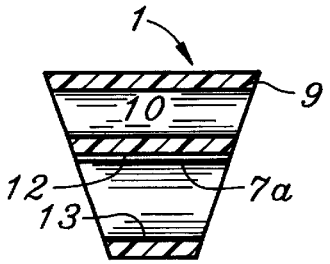

Referring to the drawings of FIGS. 2–4, the details of holder 1 will be described. An upper partial cylindrical section 6 is integrally joined with a lower partial cylindrical section 7 by a connecting section 8, as best seen in FIG. 3. The upper section 6 provides an instrument sleeve 9 and has a cylindrical passage 10 with a inside diameter slightly smaller than that of a conventional pen or pencil, preferably about 0.25 inches. The lower section 7 provides a finger engaging member 11 in the shape of a partially cylindrical passage with an inner diameter slightly smaller than the middle phalanx of a normal index finger, having a range between ½ to ⅝ inches. Finger engaging member 11 is comprised of an arcuate saddle portion 12 and an oppositely disposed gripping portion 13. Saddle portion 12 has a longitudinal dimension approximately as long as the dorsal side of the middle phalanx of a normal human finger, or approximately between 1 and 1½ inches. Gripping portion 13 has a shorter longitudinal dimension approximately one half that of saddle portion 12, or approximately between ½ and ¾ inches. Finger gripping action is provided by the flexibility of the lower section 7, which also provides for expansion or contraction to accommodate variations in finger size.

Means for preventing longitudinal movement of the writing instrument is provided by the frictional engagement of pen or pencil with the walls of passage 10. The diameter of the passage is slightly less than that of the writing instrument. Flexibility of the upper section permits expansion and insertion of the writing instrument into sleeve 9, which then grips the instrument.

Figure 2:
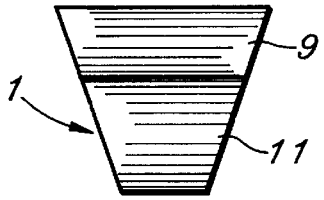
Figure 3:
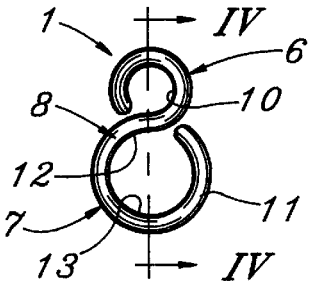

Preferably the material for the holder shown in FIGS. 1–5 is plastic, many types of common plastic material, such as polypropylene, polyethylene, or polyurethane being suitable. However metal is also acceptable as well as compositions of particulate material with plastic binders. The shape shown in FIGS. 1–5 may be folded over a mandrel after being cut from a blank sheet, either by deformation or by forming and then curing a plastic thermosetting binder. However, a preferred method, because of the uniformity of cross-section in one dimension, is to extrude the section shown in FIG. 3 and then cut the extruded section on an angle at each end as shown in FIG. 2.

Figure 5:
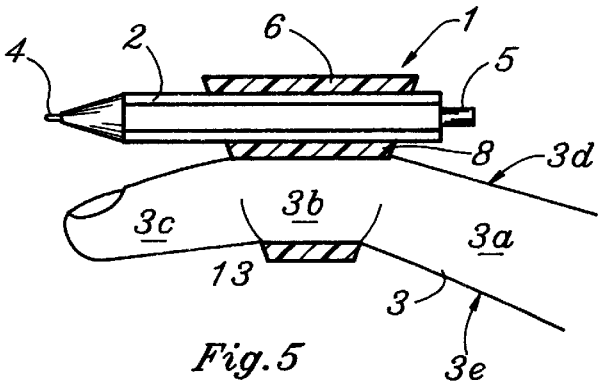

Referring to FIG. 5 of the drawing, a cross section of the holder on the index finger illustrates the operation. Parts of the index finger, for reference purposes include the proximal phalanx 3*a*, the middle phalanx 3*b*, and the distal phalanx 3*c*. The back or upper side of the finger 3 is termed the dorsal side 3*d* and the underneath or lower side is termed the ventral side 3*e*.

Because of the natural position of the finger in repose, with a slight angle assumed between adjacent joints, the ventral side of the middle phalanx is shorter than the dorsal side. The holder is designed to provide that the arcuate saddle portion 12 is about twice as long as the ventral facing gripping portion 13, as will be readily seen in the drawing. The instrument sleeve 6 holds the writing instrument 2 and the connecting section 8 holds the instrument sleeve 6 above the dorsal side 3*d* of the middle phalanx 3*b*. The scribing point 4 is held adjacent the tip of the finger so that the holder may be gripped between thumb 14 and second finger 15 and seen in FIG. 1. The scribing point may easily be manipulated by the index finger 3 together with thumb and second finger to write in the normal way.

Figure 6:
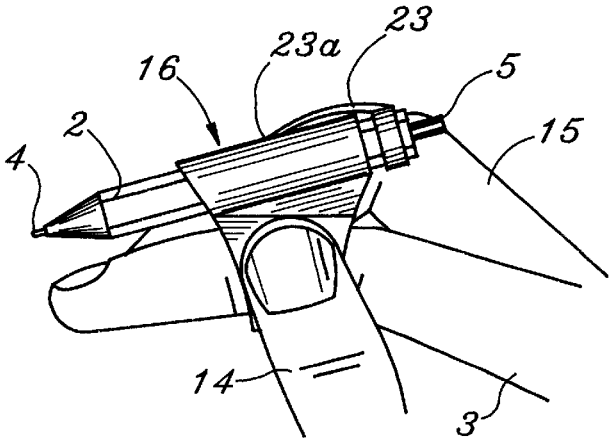

FIGS. 6 through 11 illustrate a modified form of the invention. Reference numbers are the same as those used in FIGS. 1–5 wherever possible. FIG. 6 shows a modified holder 16 holding a writing instrument 2 on the dorsal side of the middle phalanx of the index finger 3 as before. Holder 16 is gripped with thumb 14 and second finger 15. However holder 16 is adapted so that the longitudinal axis of writing instrument 2 is held at an angle to the middle phalanx so that the scribing point 4 terminates much closer to the tip of index finger 3 than in the previous version.

Figure 7:
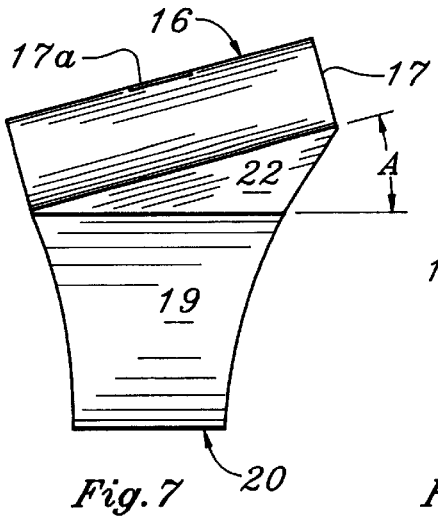
Figure 8:
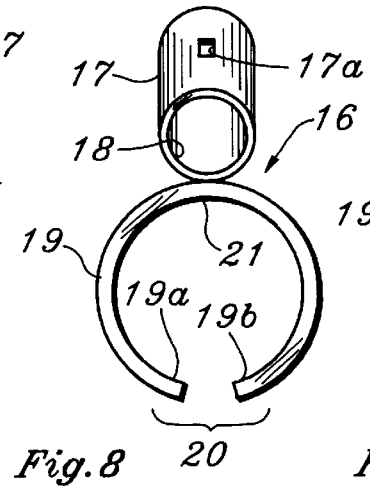
Figure 9:
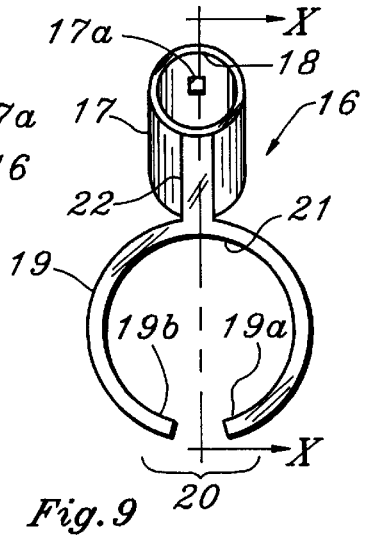
Figure 10:
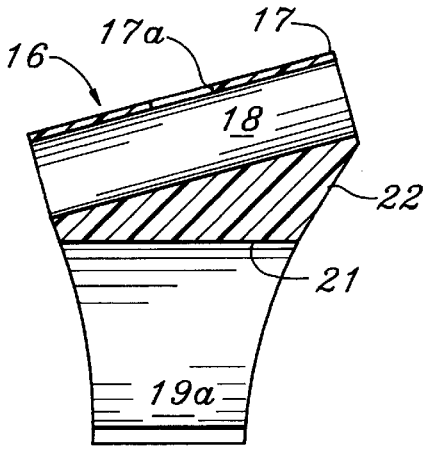

Reference to FIGS. 7–9 show the details of the holder 16. A cylindrical instrument sleeve 17 defines an internal cylindrical passage 18, which is the diameter to receive a conventional diameter writing instrument, or about 5/16 to ⅜ inches. An opening 17*a* is located midway along the upper side of the sleeve to receive a clip on the writing instrument (FIGS. 6 and 11)

A finger engaging member 19 in the shape of a partially cylindrical passage with an inner diameter slightly smaller than the middle phalanx of a normal index finger, approximately between ½ to ⅝ inches is open at the bottom where the finger engaging member is open between two flexible gripping ends 19*a* and 19*b*, together comprising a gripping portion 20. Diametrically opposite the gripping section 20 is an arcuate saddle portion 21. The saddle portion 21 has a longitudinal dimension adapted to fit on the dorsal side of the middle phalanx, while the gripping section 20 has a shorter longitudinal dimension adapted to fit on the ventral side of the middle phalanx. Connecting and holding the instrument sleeve 17 from the saddle portion 21 is a substantially triangular web 22. The web 22 holds the instrument sleeve 17 so that it forms a slight angle, about 15 degrees, with the longitudinal axis of the saddle portion 20, as indicated at A in FIG. 7. Angle A is selected to approximate the angle formed between the distal phalanx 3*c* and the middle phalanx 3*b* when the hand is in repose, as most clearly seen in FIG. 11.

Figure 11:
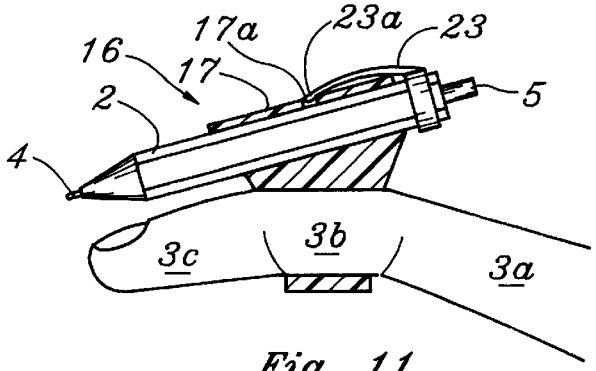

In FIGS. 6 and 11, the means for holding the writing instrument against longitudinal movement consists of a conventional pocket holding clip 23, whose end 23*a* snaps into the hole 17*a* provided in sleeve 17 for this purpose. Holder 16 may be assembled from the three basic elements described, but preferably is manufactured from plastic by injection molding, choosing a suitable plastic which will provide flexibility for the finger gripping ends 19*a*, 19*b*.

As seen in FIG. 11, the scribing point 4 may be located very close to the tip of finger 3 because of the fact that the instrument sleeve is inclined to the saddle axis. The holder is gripped between thumb 14 and middle finger 15 and manipulated as before. However, when it is not being gripped, the holder 16 does not in any way impede the articulation of the fingers.

Figure 12:
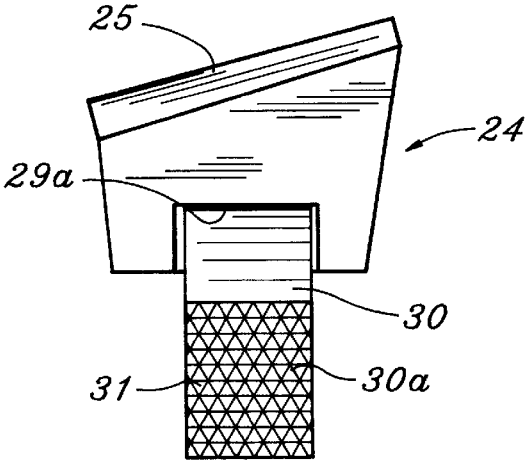
Figure 13:
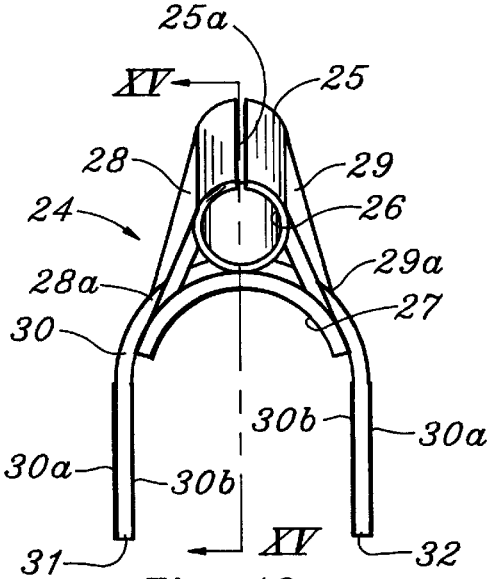
Figure 14:
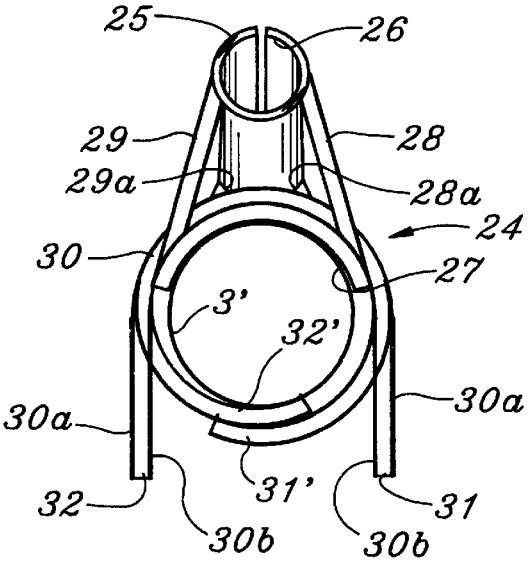
Figure 15:
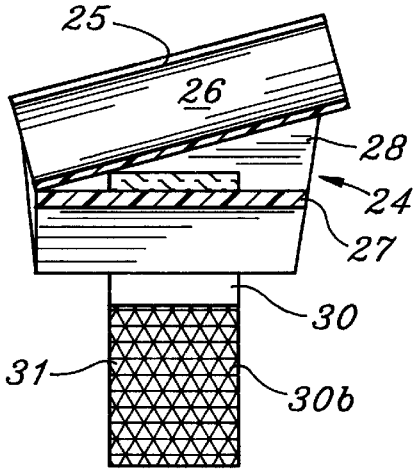

Another modification of the invention is shown in FIGS. 12 through 14. A holder shown generally at 24 includes an instrument sleeve 25 consisting of a tube with a slit 25*a* along the top and which defines a cylindrical passage 26. Sleeve 25 is mounted to an arcuate saddle member 27 by two webs 28 and 29 which connect the outer sideways of the sleeve and the saddle member in a manner which is apparent from the drawing. The sidewalls have a complex or warped shape, designed to hold the sleeve so that its cylindrical passage axis makes an angle with the longitudinal axis of the saddle member at an angle which approximates the natural angle between distal and middle phalanges of the index finger. This angle is somewhere between 10 and 20 degrees, or about 15 degrees. The length of the saddle portion is about the same length as the dorsal side of the middle phalanx, which may be between ¾ inch and one inch.

In order to hold the saddle portion 27 in place, an attachment strap 30 is attached by passing it through slots 28*a*, 29*a* provided in the respective webs 28,29 at the point where the webs connect with saddle member 27. The strap 30 is provided with double sided layers of fabric hooks 30*a* and fabric eyelets 30*b*, commercially available as Velcro together forming a gripping portion when the hooks and eyelets are overlapped in a manner well known in the art. This is illustrated in FIG. 14 where the index finger 3' cross section and the strap ends 31', 32' are all indicated in phantom lines after the holder is attached to the finger.

The width of strap 30 is chosen to be less than the length of the ventral side of the middle phalanx, or preferably about ½ inch. The use of a strap 30 allows the holder 24 to adapt to a large variation in finger size.

The holder 24 is preferably manufactured by injection molding the instrument sleeve 25, saddle portion 27 and webs 28 and 29 as a single piece of plastic and then passing a strap 30 through the slots 28*a* and 29*a*. The hook and eyelet sections 30*a* and 30*b* may extend for the full strap length, rather than simply being on the ends of the strap.

The holder 24 of FIGS. 12–14 is held and manipulated in the same manner as shown for holder 16 in FIGS. 6 and 11. The writing instrument is held in sleeve 25 against longitudinal movement by the friction of the flexible sleeve sides on either side of the slit 25*a* after the writing instrument is inserted.

Figure 16:
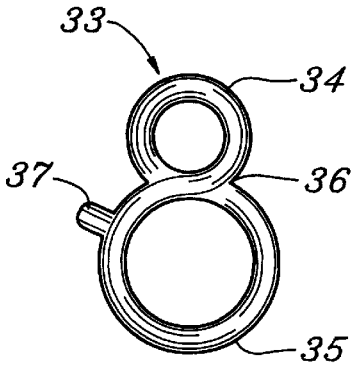
Figure 17:
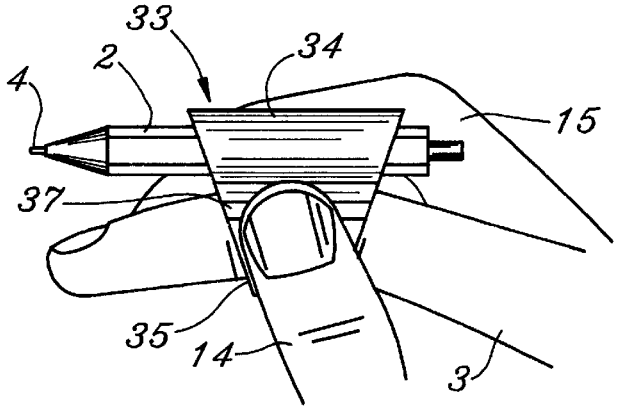

Another modified form of the invention is shown in FIGS. 16 and 17. There, the "S" shape of FIG. 3 has been modified to form a completely closed or "8" shape, and the part made of yieldable or elastomeric material so that the elastic properties of the material serve to provide the instrument holding and finger gripping functions. The holder shown at 33 includes an instrument sleeve 34 and a finger engaging member 35 constructed substantially as shown in FIG. 2, with a connecting section 36. However, the sleeve 34 and the finger engaging member 35 are completely closed, and the material is chosen from a suitable elastomeric or yieldable material. A projection 37 extends from the finger engaging member 35 at a location where the thumb 14 may contact the projection. Projection 37 may be extruded as part of the shape or molded as an integral part of an injection molding. Projection 37 serves as a means to rotate the holder on the index finger to a more comfortable or more convenient writing position if desired. An alternate form of providing a means for the thumb to effect rotation is to provide a roughened or knurled surface on the exterior of the finger engaging member.

While there has been disclosed the preferred embodiment and several modifications of the invention, it is desired to cover in the appended claims all such modifications as fall within the true spirit and scope of the invention.

I claim:

1. An improved holder for a writing instrument of the type having a scribing point on one end thereof to be held on the index finger of an operator the index finger having distal phalanx, middle phalanx, and proximal phalanx, each phalanx having dorsal and ventral sides, the improved holder comprising, a finger engaging member adapted to fit on the middle phalanx without substantially impeding articulation of the adjoining phalanges, said finger engaging member having a dorsal facing arcuate saddle portion and a gripping portion cooperating with the saddle portion to grip the middle phalanx, an instrument sleeve defining a passage adapted to receive the writing instrument, said instrument sleeve having means for preventing longitudinal movement of the writing instrument in the passage, connecting means rigidly supporting the instrument sleeve from the saddle member above the dorsal side of the middle phalanx and directing the passage so that when the writing instrument is placed in the passage the scribing point may terminate at the end of the distal phalanx on the dorsal side thereof, and means arranged to be contacted by the thumb for rotating the holder to a different position of the writing instrument with respect to the middle phalanx.

2. The combination according to claim 1, wherein said instrument sleeve, said finger engaging member and said connecting means are a single elastomeric member having a cross section substantially of an "8" configuration having a pair of loops, whereby the loops of the "8" will respectively stretch to admit and then retract to grip the writing instrument to prevent longitudinal movement, and to admit and then grip the middle phalanx of the index finger.

3. The combination according to claim 1, wherein said means for rotating the holder comprises a projection extending from the side of the saddle portion adjacent the thumb.

4. A holder for carrying a writing instrument on the index finger out of the way but operatively positioned for usage, comprising:

a finger engaging member comprising a saddle portion, having an arcuate surface adapted to rest on the dorsal side of the middle phalanx of the index finger of an operator and having a first longitudinal dimension, and a gripping portion with a second longitudinal dimension adapted to fit the middle phalanx, said gripping portion attached to the saddle portion and having means for gripping said middle phalanx, an instrument sleeve extending along said saddle portion of the finger engaging member and defining a passage adapted to receive a writing instrument and including means adapted to hold a writing instrument in place against longitudinal movement, connecting means rigidly supporting the instrument sleeve from the saddle portion above the dorsal side of the middle phalanx and directing the passage so that when the writing instrument is placed in the passage the scribing point may terminate at the end of the distal phalanx on the dorsal side thereof, and means arranged to be contacted by the thumb for rotating the holder on the middle phalanx of the index finger to a different position of the writing instrument.

5. combination according to claim 4, wherein said instrument sleeve, said finger engaging member and said connecting means are a single elastomeric member having a cross section substantially of an "8" configuration, whereby the loops of the "8" will respectively stretch to admit and then retract to grip the writing instrument to prevent longitudinal movement, and will admit and then grip the middle phalanx of the index finger.

6. The combination according to claim 4 wherein said means for rotating the holder comprises a projection extending from the side of the saddle portion adjacent the thumb.

* * * * *